US010683966B2

(12) United States Patent
Xiao et al.

(10) Patent No.: US 10,683,966 B2
(45) Date of Patent: Jun. 16, 2020

(54) LIQUID STORAGE CONTAINER

(71) Applicant: Gree Electric Appliances, Inc. of Zhuhai, Guangdong (CN)

(72) Inventors: Fujia Xiao, Guangdong (CN); Zhiqiang Miao, Guangdong (CN); Yulin Gu, Guangdong (CN); Jiachun Liu, Guangdong (CN); Ningfang Ma, Guangdong (CN); Haomin Lian, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 195 days.

(21) Appl. No.: 15/576,482

(22) PCT Filed: Jul. 6, 2016

(86) PCT No.: PCT/CN2016/088870
§ 371 (c)(1),
(2) Date: Nov. 22, 2017

(87) PCT Pub. No.: WO2017/008665
PCT Pub. Date: Jan. 19, 2017

(65) Prior Publication Data

US 2018/0156386 A1 Jun. 7, 2018

(30) Foreign Application Priority Data

Jul. 15, 2015 (CN) ..... 2015 1 0416012

(51) Int. Cl.
*F17C 1/00* (2006.01)
*F25B 43/00* (2006.01)
(Continued)

(52) U.S. Cl.
CPC ..... *F17C 1/005* (2013.01); *F17C 13/025* (2013.01); *F17C 13/06* (2013.01); *F17C 13/084* (2013.01);
(Continued)

(58) Field of Classification Search
CPC ..... F17C 13/025; F17C 13/084; F17C 2205/0338; F17C 1/005; F25B 43/006
See application file for complete search history.

(56) References Cited

U.S. PATENT DOCUMENTS 1,865,006 A * 6/1932 Heath ..... G10K 9/02 116/138
1,923,011 A * 8/1933 Moulton ..... F16F 9/0218 188/301
(Continued)

FOREIGN PATENT DOCUMENTS

CN 201786665 U 4/2011
CN 202813927 U 3/2013
(Continued)

*Primary Examiner* — Angelisa L. Hicks
(74) *Attorney, Agent, or Firm* — The Webb Law Firm

(57) ABSTRACT

A liquid storage container comprises: a first lid; a container body having an opening on one end, an interior of the container body and the lid forming a chamber. The opening end of the first lid and the opening end of the container body are rotatably and sealingly connected; and a first pipe and a second pipe communicating the chamber with the outside. The first pipe is provided on the first lid. The second pipe is provided on the container body.

16 Claims, 4 Drawing Sheets

(51) Int. Cl.
*F17C 13/02* (2006.01)
*F17C 13/06* (2006.01)
*F17C 13/08* (2006.01)

(52) U.S. Cl.
CPC ..... *F25B 43/00* (2013.01); *F25B 43/006* (2013.01); *F17C 2201/0104* (2013.01); *F17C 2205/0338* (2013.01); *F17C 2205/0358* (2013.01); *F25B 2400/16* (2013.01)

(56) References Cited

U.S. PATENT DOCUMENTS 2,967,427 A * 1/1961 Le Blanc ..... B60T 17/22 73/149
3,645,170 A * 2/1972 Varouxis ..... F15B 11/06 91/399
3,918,447 A * 11/1975 Inkster ..... A61M 16/00 128/205.18
4,528,826 A * 7/1985 Avery, Jr. ..... F25B 43/003 62/292
4,836,198 A * 6/1989 Gates ..... A61M 16/0072 128/205.18
5,868,002 A * 2/1999 Matsubayashi ..... B60H 1/3229 62/507
6,125,652 A * 10/2000 Vogel ..... F25B 41/00 62/509
6,412,476 B1 * 7/2002 Thompson ..... B60K 15/077 123/516
6,425,252 B1 * 7/2002 Kobayashi ..... F17C 13/002 62/292
7,810,351 B2 * 10/2010 Westermeyer ..... F25B 43/02 62/470
7,918,107 B2 4/2011 Klotten et al.
2003/0035731 A1 2/2003 Kim
2009/0162214 A1 * 6/2009 Bonner ..... F04B 23/028 417/199.1
2013/0181012 A1 * 7/2013 Nehren ..... B01F 13/1055 222/390
2015/0122835 A1 * 5/2015 Gonzalez ..... B65D 21/083 222/105
2015/0204590 A1 7/2015 Baik et al.

FOREIGN PATENT DOCUMENTS

CN 204285908 U 4/2015
CN 105041648 A 11/2015
CN 204806748 U 11/2015
CN 205013288 A 2/2016
CN 204313545 U 5/2016
DE 3701086 A1 8/1988
DE 102006031197 A1 1/2008
JP 201498500 A 5/2014
KR 20020002839 A * 1/2002
KR 20020002839 B1 1/2002
WO 03102422 A1 12/2003
WO 2014035133 A1 3/2014
WO 2014035134 A1 3/2014

* cited by examiner

LIQUID STORAGE CONTAINER

CROSS-REFERENCE TO RELATED APPLICATIONS

This application is the United States national phase of International Application No. PCT/CN2016/088870 filed Jul. 6, 2016, and claims priority to Chinese Patent Application No. 201510416012.7 filed Jul. 15, 2015, the disclosures of which are hereby incorporated in their entirety reference.

BACKGROUND OF THE INVENTION

The present application relates to the field of freezing, cold storage and refrigeration equipment, in particular to a liquid storage container.

DESCRIPTION OF RELATED ART

In the industry of freezing, cold storage and refrigeration equipment, function of a liquid storage container for storing a liquid refrigerant is extremely important, especially for a condensing unit and a compressor unit, which units are provided respectively without an evaporator and a condenser. When the units are to be connected to the entire operating refrigeration system during the installation phase, all the required liquid refrigerant is stored in a liquid storage container. Thus, when designing and developing such units, the liquid storage container is especially important. When selecting a model in system design, the selection is usually made according to a volume. However, as a liquid storage container has a fixed volume and fixedly positioned inlet and outlet pipes, such that model selection is subject to some restriction, such that a model of liquid storage container cannot be used universally. Basically, each unit has to be provided with a specific liquid storage container, which is disadvantageous for the design and development of the entire system of a series of units. Moreover, as being restricted by positions of the inlet and outlet pipes, there is too much turning in the running direction of a pipeline, resulting in such problems as stress and strain going beyond the standards, etc.

SUMMARY OF THE INVENTION

In view of the above, the present application provides a liquid storage container having a port with an adjustable relative position.

Another object of the present application to provide a liquid storage container having a variable volume.

In order to realize this object, the present application takes a technical solution as the following:

A liquid storage container according to the present application, comprises: a first lid; a container body having an opening on one end, an interior of the container body and the lid forming a chamber, the opening end of the first lid and the opening end of the container body being rotatably connected; a first pipe and a second pipe communicating the chamber with the outside, wherein the first pipe is provided on the first lid, and the second pipe is provided on the container body.

By arranging such that the first lid is rotatably and sealingly connected on the container body with the first pipe being provided on the first lid, when the first lid is rotated with respect to the container body, position of the first pipe is changed with respect to the container body along with the first lid, and relative position of the two pipes is adjustable within 360 degrees. This arrangement is advantageous for the layout and design of the entire system, and allows a simple and beautiful pipe connection without too much turning in the running of a pipeline thereby.

In one embodiment, the liquid storage container as mentioned above further comprises a volume adjusting portion movable inside the chamber, the volume adjusting portion separating the chamber into a first chamber and a second chamber which are independent from one another, the first pipe and the second pipe being communicating the first chamber with the outside, and the first chamber having a volume variable by varying a position of the volume adjusting portion inside the chamber.

By providing the volume adjusting portion, the chamber is separated into a first chamber and a second chamber, the first chamber serving as a liquid storage portion, by varying a position of the volume adjusting portion, a volume of the liquid storage portion is adjustable.

In one embodiment, in the liquid storage container as mentioned above, the volume adjusting portion comprises a separator plate and an adjusting mechanism, the separator plate being provided movably inside the chamber, the adjusting mechanism being configured to drive the separator plate.

Preferably, in the liquid storage container as mentioned above, the adjusting mechanism comprises a guide mechanism and an elastic element, the guide mechanism being provided inside the chamber such that the separator plate is movable along the guide mechanism, the elastic element applying an elastic force to the separator plate so as to move the separator plate.

By providing the elastic element, the volume of the liquid storage portion is adjustable automatically according to a pressure of the liquid storage portion.

In one embodiment, in the liquid storage container as mentioned above, the adjusting mechanism comprises an adjusting screw, the adjusting screw having one end coupled to the separator plate and another end passing through the first lid and connected threadedly with the first lid through a threaded portion.

The adjusting screw and the separator plate are provided for allowing a position of the separator plate to be adjustable manually or automatically. When the adjusting screw is rotated by the threaded portion, the adjusting screw is movable axially relative to the first lid, so as to drive the separator plate to move axially, thereby to vary a volume of the first chamber and of the second chamber. The adjusting screw may be driven manually, or be driven by a drive mechanism, such as a motor or the like.

In one embodiment, in the liquid storage container as mentioned above, the adjusting screw is provided with a scale marking.

In one embodiment, the liquid storage container as mentioned above comprises a pressure regulating means for regulating pressure of the second chamber.

In one embodiment, in the liquid storage container as mentioned above, a connection holder is provided on the container body.

In one embodiment, in the liquid storage container as mentioned above, an end of the first lid is provided externally with a threaded portion, a stopper boss is provided on an outer circumference of the container body, a nut disposed on an outer circumference of the stopper boss, the stopper boss limiting a axial position of the nut, the nut being threadedly connected with a threaded portion of the first lid.

In one embodiment, in the liquid storage container as mentioned above, a sealing ring is provided between the first lid and the container body.

In one embodiment, in the liquid storage container as mentioned above, the first lid is rotatably and sealingly connected with the container body by means of a thread.

In one embodiment, in the liquid storage container as mentioned above, in an operating state, ports of the first pipe and the second pipe inside the chamber are positioned at substantially the same level.

In one embodiment, in the liquid storage container as mentioned above, the container body comprises a second lid and a cylindrical body having an opening on each end, at a first opening end of the cylindrical body, the first lid being rotatably and sealingly connected with the cylindrical body, and at a second opening end of the cylindrical body, the second lid being rotatably and sealingly connected with the cylindrical body, the second pipe being provided on the second lid.

By providing the second lid and by providing the second pipe on the second lid, positions of the first pipe and the second pipe relative to the cylindrical body are adjustable, and in the case where the holder is mounted at a fixed position with respect to the cylindrical body, positions of the two pipes may also be easily adjustable such that operation connecting pipeline with the liquid storage container is more convenient.

In one embodiment, in the liquid storage container as mentioned above, the first lid and/or the second lid are/is rotatably and sealingly connected with the cylindrical body by means of a thread.

In an operating state, ports of the first pipe and the second pipe inside the chamber are positioned at substantially the same level, such that there is no need to distinguish which of the first pipe and the second pipe should serve as an inlet pipe and which thereof should serve as an outlet pipe, which may facilitate connecting pipeline of the entire system. Productivity is greatly increased as inlet and outlet pipes may not be distinguished.

In one embodiment, in the liquid storage container as mentioned above, relative position of ports of the first pipe and the second pipe in communication with the outside is variable along with relative rotation of the first lid and the second lid.

By arranging such that the ports of the first pipe and the second pipe in communication with the outside are offset from axes of rotation of the lids, such as in a fashion that the ports are provided on side walls of the lids, the ports of the first pipe and the second pipe in communication with the outside are rotatable along with the lids and positions of ports are variable with respect to the cylindrical body.

In one embodiment, in the liquid storage container as mentioned above, a sealing ring is provided between at least one of the lids and the cylindrical body, an end of the lid is provided externally with a threaded portion, a stopper boss is provided on an outer circumference of the cylindrical body, a nut disposed on an outer circumference of the stopper boss, the stopper boss limiting a axial position of the nut, the nut being threadedly connected with a threaded portion of the lid.

Some embodiments in the present application have advantageous effects as the following:

1. Positions of the inlet and outlet pipes are adjustable in any angle within 360° which is advantageous for the layout and design of the entire system, and allows a simple and beautiful pipeline connection without too much turning in the running of a pipeline thereby.

2. With an adjustable volume, there is no need to provide each unit model with a specific liquid storage container.

3. Costs are saved, as a single liquid storage container may be used universally for the entire series of units;

4. The volume adjusting mechanism is provided with a scale marking such that the volume of the liquid storage portion may be adjusted easily and rapidly to a designated volume.

BRIEF DESCRIPTION OF THE ACCOMPANYING DRAWINGS

By the below description of the embodiments according to the present application with reference to the drawings thereof, the above-mentioned and further objects, features and advantages of the present application will become more clear, in the drawings.

DETAILED DESCRIPTION OF THE PREFERRED EMBODIMENTS

The present application will be described below with reference to the embodiments, but the present application is not limited to these embodiments. Some specific details are described in detail in the following detailed description of the present application. For those skilled in the art, the present application may be understood without reference to these details. In order to avoid obscuring the essence of the present application, commonly known methods are not described in detail.

Figure 1:
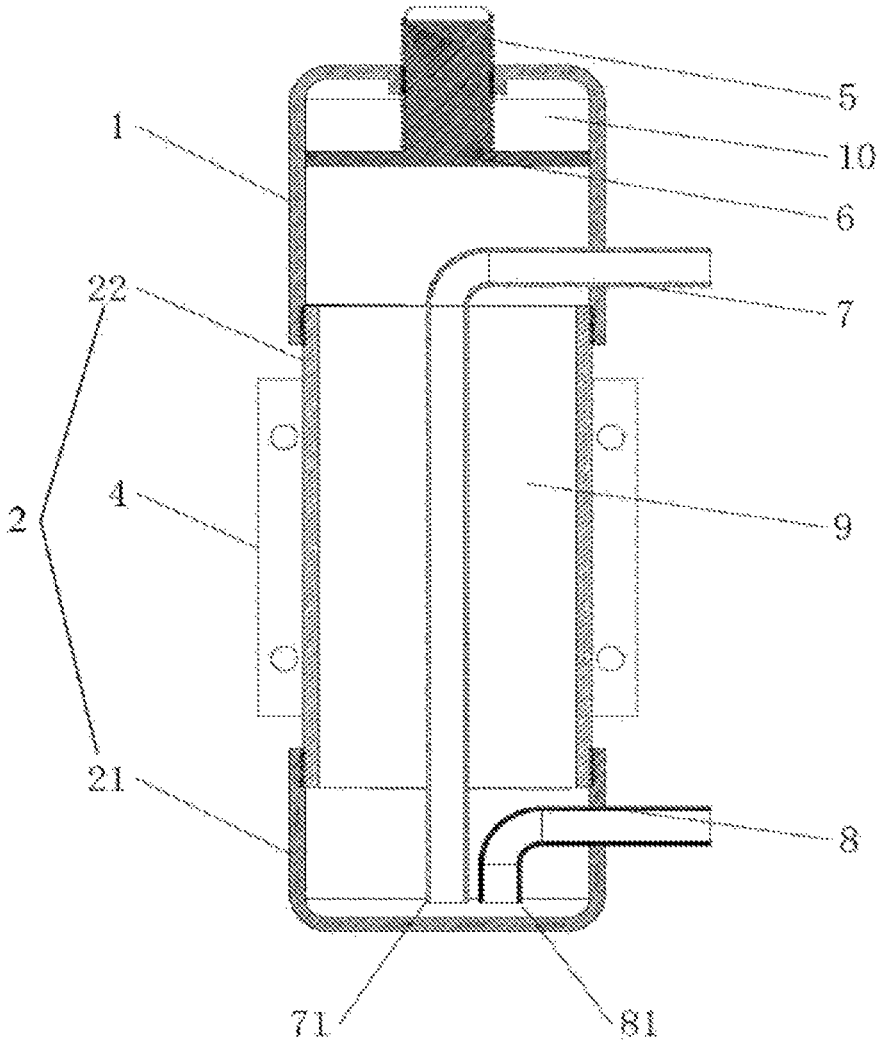
FIG. 1 is a sectional view of the liquid storage container according to the present application.
Figure 2:
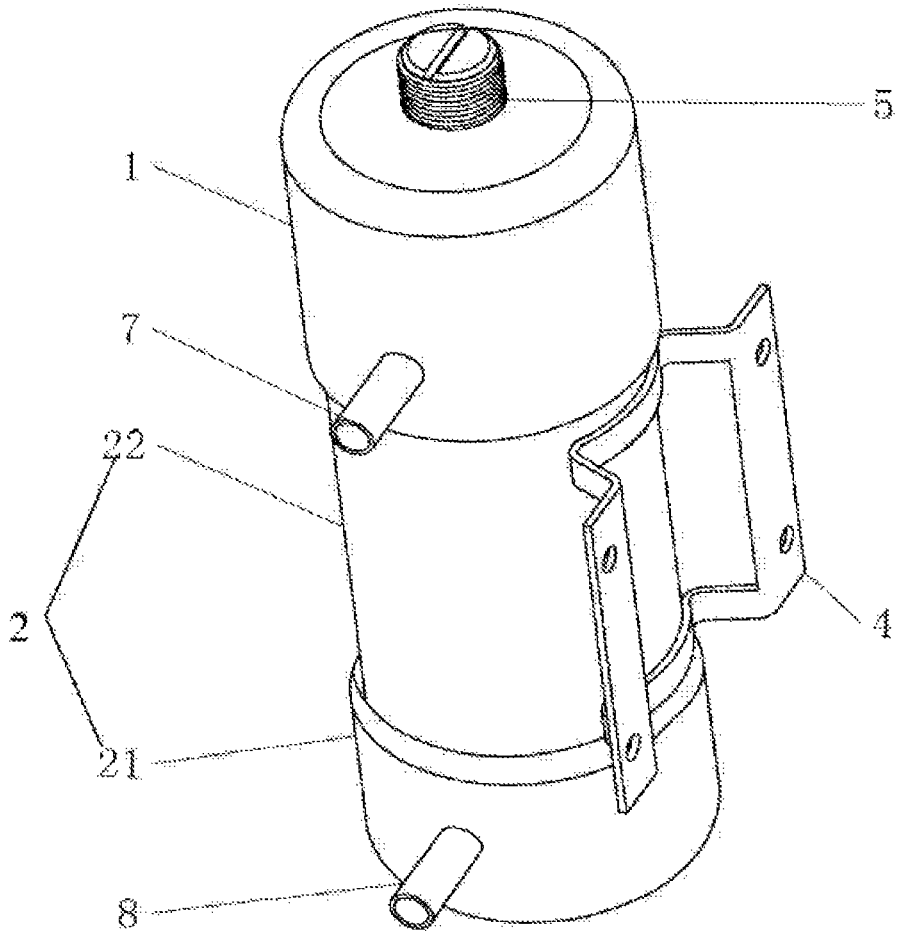
FIG. 2 is a three-dimensional view of the liquid storage container according to the present application.
Figure 4:
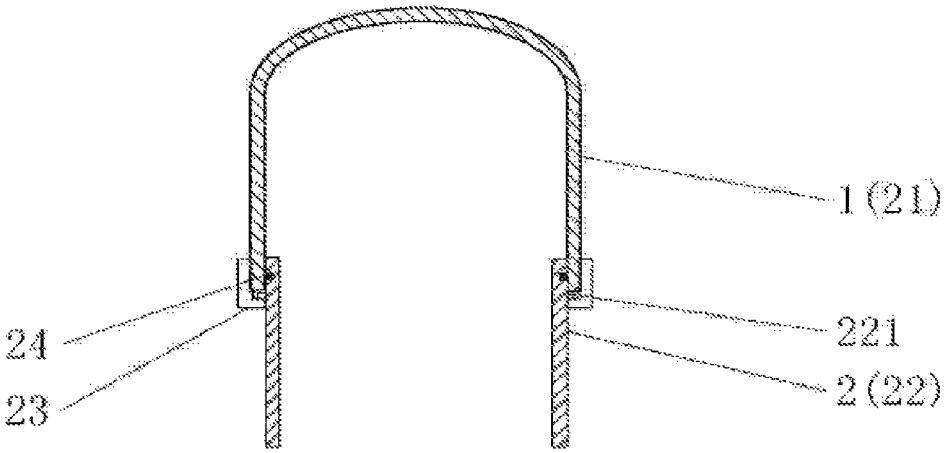
FIG. 4 is an illustrative view of another embodiment of a connection manner of the lid with the cylindrical body of the liquid storage container according to the present application.

FIGS. 1 and 2 show the structure of the liquid storage container according to the present application. The liquid storage container comprises a first lid 1 and a container body 2, an interior of the container body and the lid forming a chamber, the container body 2 having an open end, an opening end of the first lid and an opening end of the container body 2 being rotatably and sealingly connected. The liquid storage container further comprises a first pipe 7 and a second pipe 8 communicating the chamber with the outside, wherein the first pipe 7 is provided on the first lid 1, and the second pipe 8 is provided on the container body. As a preferred embodiment, in FIG. 1 the first lid 1 and the container body 2 are threadedly and sealingly connected, but the connection is not limited to the manner as shown in FIG. 1, and may also be in the manner as shown in FIG. 4. In FIG. 4 a sealing ring 24 is provided between the first lid 1 and the container body 2, a threaded portion is provided externally on an end portion of the first lid 1, and a stopper boss 221 is provided on an outer circumference of the container body 2, a nut 23 is disposed on an outer circumference of the stopper boss 221 such that the stopper boss 221 limits a axial position of the nut, the nut 23 is threadedly connected to the threaded portion of the first lid 1, and the sealing connection between the first lid 1 and the container body 2 is effected by the sealing ring 24. The first lid 1 is rotatably fixed to the container body 2 by the nut 23 to effect a rotatable and sealing connection between the first lid 1 and the container body 2. The first lid 1 closes the opening of the container body 2, and a chamber is formed between the first lid 1 and the container body 2. By rotatable and sealing connection between the first lid 1 and the container body 2, the first pipe 7 provided on the first lid 1 and the second pipe 8 provided on the container body, a position of the first pipe 7 relative to the second pipe 8 is adjustable with rotation of the first lid 1, position for pipeline may be adjusted at any time according to the specific site condition, and it is very convenient to make such an adjustment, such that the connecting pipeline is very simple, a length of the pipeline is shortened, turning on the pipeline is reduced, allowing a smooth flow of a medium carried therein.

Figure 3:
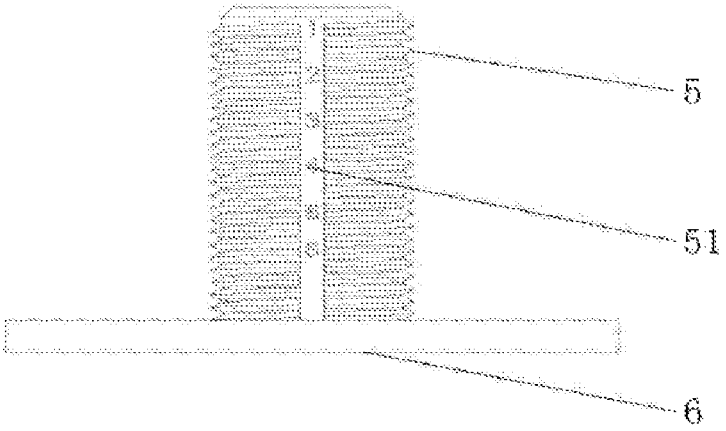
FIG. 3 is an illustrative view of an embodiment of the volume adjusting portion of the liquid storage container according to the present application.

As one embodiment, the liquid storage container according to the present application further comprises a volume adjusting portion which, as shown in FIG. 3, is formed by a separator plate 6 and an adjusting screw 5. The separator plate 6 and the adjusting screw 5 may be formed integrally, or be formed separately but being assembled together. The separator plate 6 separates the chamber into a first chamber 9 and a second chamber 10, the first chamber and the second chamber being independently from one another and not in communication with one another, wherein the first chamber 9 serves as a liquid storage chamber and the second chamber 10 serves as an adjusting chamber. The first lid 1 is in shape of a cup comprising a bottom wall and a side wall. The separator plate 6 is provided inside the chamber. As shown in FIG. 1, in this embodiment, the separator plate 6 is provided inside the first lid 1 such that it is fitted with an inner wall of the side wall of the first lid. However, the arrangement of the separator plate is not limited to such a manner. In fact, it is also allowable to provide the separator plate 6 inside the container body 2 such that it is fitted with an inner wall of the container body 2. The adjusting screw 5 has an end coupled to the separator plate 6 and another end passing through an aperture in the first lid 1 to reach the outside of the liquid storage container. A threaded portion is provided between the adjusting screw 5 and the aperture formed in a bottom wall of the first lid 1. Rotation of the adjusting screw 5 causes an axial movement of the adjusting screw 5 relative to the first lid 1 so as to bring along therewith a movement of the separator plate 6 within the chamber. Preferably, the adjusting screw 5 is provided with a volume scale marking 51 corresponding to an actual volume of the liquid storage chamber therein, such that an operator is able to see clearly the adjustment condition of the volume of the interior, so as to effect an accurate volume adjustment. The adjusting screw 5 may be driven by a manual adjustment mechanism so as to be rotated manually, or may be driven by a drive mechanism, such as a motor or the like.

Figure 5:
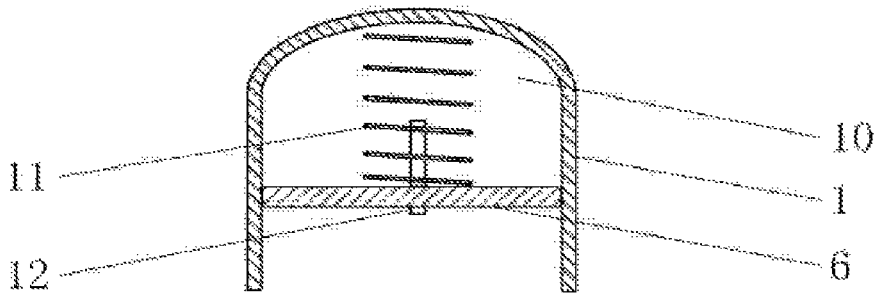
FIG. 5 is an illustrative view of another embodiment of the volume adjusting portion of the liquid storage container according to the present application.

Besides the structure of the volume adjusting portion as shown in FIG. 1, as another preferred embodiment, the volume adjusting portion may be also be constructed as an elastic element to adjust a volume of the liquid storage chamber according to a pressure of the liquid storage chamber. As shown in FIG. 5, the adjusting mechanism comprises a separator 6, a guide mechanism and an elastic element. The guide mechanism may be a guide rail 12 or a slide rod, and the separator plate 6 may be provided with an engaging hole to cooperate with the guide rail 12 or the slide rod, such that the separator plate 6 is movable along the guide rail 12 or the slide rod within the chamber. The elastic element may comprise a spring 11 applying an elastic force to the separator plate 6 to move the separator plate 6. In such a manner, the volume of the liquid storage chamber may be adjusted according to the pressure of the liquid storage chamber. When there is a great pressure of the liquid storage chamber, the spring 11 is compressed, and the separator plate 6 is driven such that the liquid storage space becomes large; and when there is a small pressure of the liquid storage chamber, the spring 11 extends such that the liquid storage space becomes small.

In one embodiment, the container body 2 is provided with a connecting holder 4 configured to fix and mount the container body 2. The connecting holder may be connected by welding or by other means.

In one embodiment, as shown in FIG. 1, the separator plate 6 is arranged inside the first lid 1, and disposed between the bottom wall of the first lid 1 and the first pipe 7, such that the first pipe 7 does not need to pass through the separator plate 6 in which case an additional seal does not need to be provided at the aperture. In the case where the separator plate 6 is disposed on the container body 2, the first pipe 7 passes through the separator plate 6. Further, the second pipe 8 is provided on the container body 2. The second pipe 8 communicates the first chamber 9 with the outside. The first lid 1 is rotatable to vary a position of the first lid 1 relative to the container body 2, so as to vary a position of the first pipe 7 relative to the second pipe 8, thereby to meet the requirement for different pipeline connections. However, as the position of the connecting holder is usually fixed, the mounting position of the second pipe 8 may also be restricted, in which case only the position of the first pipe 7 is adjustable, and such an adjustment is not sufficiently flexible.

In this regard, as one embodiment, the container body 2 is designed into a structure having separate parts, comprising a cylindrical body 22 having an opening on each end and a second lid 21. As shown in FIGS. 1 and 2, the second lid 21 has a cup-shaped structure comprising a bottom wall and a side wall. The second lid 21 is rotatably and sealingly connected with the cylindrical body 22 at a second opening end of the cylindrical body 22 so as to form the container body 2. The first lid 1 is rotatably and sealingly connected with the cylindrical body 22 at a first opening end of the cylindrical body 22. The rotatable and sealing structure between the second lid 21 and the cylindrical body 22 may be identical with or different from that of the first lid 1. The specific sealing manner is identical with the sealing manner of the first lid 1 and the container body 2 as mentioned above. The second pipe 8 is provided on the second lid 21 for communicating the first chamber 9 with the outside. The relative position of ports of the first pipe 7 and the second pipe 8 in communication with the outside may be variable along with relative rotation of the first lid and the second lid. In the present embodiment, the first pipe 7 and the second pipe 8 are each arranged in an L-shape. The L-shape has one portion thereof extending along an axis of the cylindrical body 22 and another portion thereof extending to the outside from the side wall of the first lid 1 or the second lid 2. In order to prevent the first pipe 7 and the second pipe 8 from interfering from one another, upon rotation of the first lid 1 and the second lid 21, the L-shaped portions of the first pipe 7 and the second pipe 8 may be spaced on an axial direction and a radial direction of the cylindrical body 22, so as to reduce the mutual interference of the two pipes. In the case where the first lid 1 and the second lid 21 are each connected threadedly with the cylindrical body 22 in the manner as shown in FIG. 1, rotation of the first lid 1 and/or the second lid 21 may cause a displacement of the first lid 1 and/or the second lid 21 in an axial direction of the cylindrical body 22 such that there is a minor change with the volume of the liquid storage container. In the case where it is required to make an accurate control over the volume of the liquid storage container, after the first lid 1 and/or the second lid 21 are/is rotated to a desired position, it needs to adjust the volume of the liquid storage portion by adjusting the volume adjusting portion so as to control accurately the volume of the liquid storage portion at a volume as desired.

Further, in one embodiment, ports 71 and 81 of the first pipe and the second pipe positioned inside the chamber are at the same level, in order to further improve the versatility of the liquid storage container and the convenience of the connection. For example, in FIG. 1, in an operating state, the cylindrical body 22 is positioned vertically, where the ports 71 and 81 are at substantially the same level, such that there is no need to distinguish which of the first pipe and the second pipe should serve as an inlet pipe and which thereof should serve as an outlet pipe, which may facilitate pipeline connection of the entire system. Even if rotation of the first lid 1 and the second lid 21 may cause a minor change to the height of the ports 71 and 81, effect of such a change is negligible. Productivity is greatly increased as inlet and outlet pipes may not be distinguished. Further, in the operating state, it is not limited to that the liquid storage container is positioned vertically. When the liquid storage container is positioned horizontally or positioned otherwise, shapes and positions of the first pipe 7 and the second pipe 8 may be adjusted correspondingly, such that the ports are at substantially the same level so as to produce the same effect.

Besides, in one embodiment, in order to prevent the second chamber 10 from exhibiting an overly high pressure or an overly low pressure so to affect the adjustment of the first chamber 9 when a volume adjustment is made to the first chamber 9, the second chamber 10 may be provided with a pressure regulating means such as a pressure regulating valve or a small hole may be provided in the second chamber 10, so as to adjust timely a pressure of the second chamber when the second chamber 10 exhibits on an overly low or high pressure, such that the volume of the first chamber 9 may be adjusted successively.

Besides, it needs to be noted that name and position arrangement for the first lid, the second lid, the first chamber, the second chamber, the first pipe, the second pipe and the volume adjusting portion is not limited to that as shown in FIG. 1. Position of the first lid relative to the second lid, position of the first chamber relative to the second chamber and position of the first pipe relative to the second pipe each may be adjusted, so far as it can produce the technical effect of the present application.

In addition, it will be understood by a person skilled in the art that the drawings provided herein are for illustrative purposes and that the drawings are not necessarily to scale.

At the same time, it should be understood that exemplary embodiments are provided so that this disclosure is complete and scope thereof is fully conveyed to a person skilled in the art. A number of specific details (e.g., specific parts, examples of devices) are given to provide a thorough understanding of the present disclosure. A person skilled in the art will understand that the exemplary embodiments may be implemented in many different forms without taking the specific details, and that the exemplary embodiments should not be construed as limiting the scope of the disclosure. In some exemplary embodiments, commonly known device structures and commonly known techniques are not described in detail.

The terminology used herein is for the purpose of describing only a particular exemplary embodiment and is not intended to be limiting. As used herein, the singular forms "a", "one"; and "the" may also be intended to include the plural form unless it is indicated specifically otherwise in the context. The terms "comprise", "include" and "have" are inclusive and thus clearly indicate the presence of the features, entireties, elements and/or components, but do not exclude the presence or addition of one or more other features, entireties, elements, components, and/or combinations thereof.

When an element or layer is referred to as being "on" on another element or layer, "joined", "connected to" or "coupled to" another element or layer, it may be directly on another element or layer, be directly joined, connected or coupled to another element or layer, or there may be an intermediate element or layer. In contrast, when an element is referred to as being "directly" on another element or layer, "directly joined to", "directly connected" or "directly coupled to" another element or layer, there may be no intermediate element or layer. Other words used to describe the relationship between elements should be interpreted in a similar manner (e.g., "between" and "directly between", "adjacent" and "directly adjacent", etc.). As used herein, the term "and/or" includes any or all of the combinations of one or more associated items.

Although the terms first, second, third, etc. may be used herein to describe various elements, components, regions, layers and/or sections, these elements, components, regions, layers and/or sections should not be limited by these terms. These terms may be used only to distinguish one element, component, region, layer or section from another element, region, layer, or sector. Terminology such as "first", "second", and other numerical terms are not used to mean order or sequence unless it is indicated specifically in the context. Thus, the first element, component, region, layer, or section discussed below may be referred to as a second element, component, region, layer, or section without departing from the teachings of the exemplary embodiment. Besides, in the description of the present application, the meaning of "plural" is two or more, unless otherwise specified.

Space-related terms such as "inside", "outside", "under", "below", "lower portion", "above", "upper portion" and the like are used herein to describe the relationship of an element or feature to another element or feature as illustrated in a figure. It will be understood that spatially related terms may be intended to encompass different orientations of the device in use other than the orientation depicted in the drawing. For example, if the device in the figure is reversed, the element described as being "below" or "under" the other element will then be positioned "above" the other element or feature. Thus, the exemplary term "below" can include both the top and bottom orientations. The device may be oriented (rotated 90 degrees or otherwise) in other ways, and spatially related terms used herein should be interpreted accordingly.

The above-mentioned is merely preferred embodiments of the present application and is not intended to limit the present application, and for those skilled in the art, the present application may have various variations and modifications. Any modifications, equivalent substitutions, improvements, and the like within the spirit and principles of the present application are intended to be included within the scope of the present application.

The invention claimed is:

1. A liquid storage container, comprising:

a first lid;

a container body having an opening on one end, an interior of the container body and the first lid forming an inner chamber; and a first pipe and a second pipe communicating the inner chamber with the outside, wherein the first pipe is provided on the first lid, and the second pipe is provided on the container body;

wherein the first lid is rotatably connected to the container body at the opening on one end thereof, and a position of the first pipe relative to the second pipe is adjustable with rotation of the first lid with respect to the container body.

2. The liquid storage container according to claim 1, further comprising a volume adjusting portion movable inside the inner chamber, the volume adjusting portion separating the inner chamber into a first chamber and a second chamber which are independent from one another, the first pipe and the second pipe communicating the first chamber with the outside, and the first chamber having a volume variable by varying a position of the volume adjusting portion inside the inner chamber.

3. The liquid storage container according to claim 2, wherein the volume adjusting portion comprises a separator plate and an adjusting mechanism, the separator plate being provided movably inside the inner chamber, the adjusting mechanism being configured to drive the separator plate.

4. The liquid storage container according to claim 3, wherein the adjusting mechanism comprises a guide mechanism and an elastic element, the guide mechanism being provided inside the inner chamber such that the separator plate is movable along the guide mechanism, the elastic element applying an elastic force to the separator plate so as to move the separator plate.

5. The liquid storage container according to claim 3, wherein the adjusting mechanism comprises an adjusting screw, the adjusting screw having one end coupled to the separator plate and another end passing through the first lid and connected threadedly with the first lid through a threaded portion.

6. The liquid storage container according to claim 5, wherein the adjusting screw is provided with a volume scale marking.

7. The liquid storage container according to claim 2, comprising a pressure regulating means for regulating pressure of the second chamber.

8. The liquid storage container according to claim 1, wherein a connecting holder is provided on the container body.

9. The liquid storage container according to claim 1, wherein an end of the first lid is provided externally with a threaded portion, a stopper boss is provided on an outer circumference of the container body, a nut disposed on an outer circumference of the stopper boss, the stopper boss limiting an axial position of the nut, the nut being threadedly connected with a threaded portion of the first lid.

10. The liquid storage container according to claim 9, wherein a sealing ring is provided between the first lid and the container body.

11. The liquid storage container according to claim 1, wherein the first lid and the container body are rotatably and sealingly connected by means of a thread.

12. The liquid storage container according to claim 1, wherein in an operating state, ports of the first pipe and the second pipe inside the inner chamber are positioned at substantially the same level.

13. The liquid storage container according to claim 1, wherein the container body comprises a second lid, and a cylindrical body having an opening on each end, at a first opening end of the cylindrical body, the first lid being rotatably and sealingly connected with the cylindrical body, and at a second opening end of the cylindrical body, the second lid being rotatably and sealingly connected with the cylindrical body, the second pipe being provided on the second lid.

14. The liquid storage container according to claim 13, wherein the first lid and/or the second lid are/is rotatably and sealingly connected by means of a thread.

15. The liquid storage container according to claim 13, wherein relative position of ports of the first pipe and the second pipe in communication with the outside is variable along with relative rotation of the first lid and the second lid.

16. The liquid storage container according to claim 13, wherein a sealing ring is provided between at least one of the lids and the cylindrical body, an end of the lid is provided externally with a threaded portion, a stopper boss is provided on an outer circumference of the cylindrical body, a nut disposed on an outer circumference of the stopper boss, the stopper boss limiting a axial position of the nut, the nut being threadedly connected with a threaded portion of the lid.

* * * * *